US006314644B1

(12) United States Patent
Raeker

(10) Patent No.: US 6,314,644 B1
(45) Date of Patent: Nov. 13, 2001

(54) BOX OPENING DEVICE AND METHOD OF USE

(76) Inventor: Roger Raeker, 855 Lincoln St., Anoka, MN (US) 55303

( * ) Notice: Subject to any disclaimer, the term of this patent is extended or adjusted under 35 U.S.C. 154(b) by 0 days.

(21) Appl. No.: 09/572,639

(22) Filed: May 17, 2000

(51) Int. Cl.[7] ..... B26B 3/00
(52) U.S. Cl. ..... 30/2
(58) Field of Search ..... 30/2, 294, 317, 30/299; D8/98, 102; D7/650

(56) References Cited

U.S. PATENT DOCUMENTS

D. 175,248 * 8/1955 Carroll ..... D8/102 X
D. 356,236 * 3/1995 Lipson ..... D7/650 X

* cited by examiner

*Primary Examiner*—Douglas D. Watts
(74) *Attorney, Agent, or Firm*—Angenehm LawFirm; N. Paul Friederichs; William Flynn

(57) ABSTRACT

A box opening device including a handle having a base, a neck, and a stopping surface. The handle may be an elongated S-shape. The base may be continuous with the neck and the neck being continuous with the stopping surface. The handle ranges five to seven inches in length. The handle ranges from less than one inch to more than three inches in thickness. The handle ranges from less than one inch to more than three inches wide. A cutting mechanism having a plurality of pointed edges being homogenous with the neck and the stopping surface. A plurality of pointed edges being homogenous with the neck. A plurality of pointed edges being homogenous with the stopping surface. The handle and the pointed edges may be plastic.

8 Claims, 1 Drawing Sheet

BOX OPENING DEVICE AND METHOD OF USE

FIELD OF INVENTION

The present invention generally relates to box opening devices and, more specifically, to devices that release tape on a taped sealed box.

BACKGROUND

People receive boxes through the mail, delivery services, and from stores. Boxes may be stapled, glued or taped shut. Boxes that are taped shut may be taped with a variety of different tapes. Tapes used for boxes being shipped are very difficult to tear or rip off of the boxes. Many times the tape will be very difficult to release from the box.

People use a variety of devices to open taped boxes. People use any device within reach that may release the tape from the taped box. People use razor blades, knives, and other sharp objects to open boxes. This is particularly common in commercial settings.

Using these devices to open a taped box is potentially dangerous. Many people are injured using these devices to open boxes. Many people cut themselves or others while attempting to open the taped boxes. Some of the cuts are severe enough to cause the injured person to need to visit an emergency room to have a doctor stop the bleeding and stitch up the wound.

Using a razor blade or other sharp object causes other problems as well. When a person uses a razor blade or other sharp object to open a taped box, the person must be exceedingly careful. The person must be acutely aware of the location of the sharp object to prevent cutting themselves or other nearby people. Also, the user of the sharp object must be cognizant of how deep the edge of the sharp object is within the box. Often, the user of the sharp object will cut the contents within the box.

SUMMARY

The present invention includes a handle mechanism and a tape cutting mechanism. The tape cutting mechanism may include several pointed tips that are used to cut the tape on a taped box. The handle mechanism includes a stopping mechanism, which may be part of the handle, that prevents the tape cutting mechanism from entering too deeply within the box. The present invention may be all one piece of injection molded plastic.

The present invention cuts the tape on the box, but does not cut the box. Because the present invention only cuts the tape and not the box, the box is not damaged. The box may then be easily reused. Also, because the present invention only cuts the tape and not the box, the contents within the box are not damaged as discussed below.

The present invention releases tape on taped boxes eliminating the need to use razor blades or other sharp objects to open taped boxes. The present invention cuts the tape on the taped box without the likely possibility of cutting the person using the present invention or a nearby person. The present invention includes an edge that is sharp enough to puncture and cut any tape used to tape a box shut; however, dull enough to substantially avoid puncturing or cutting a person's skin if the present invention comes into a forceful contact with a person's skin.

The present invention will not cut or damage contents within the taped box. The present invention includes a stopping mechanism, which may be part of the handle, that prevents the present invention from being placed too deeply within a box. The present invention will not reach the contents within the box; therefore, the present invention will not damage the contents of the box.

DETAILED DESCRIPTION OF THE FIGURES

Figure 1:
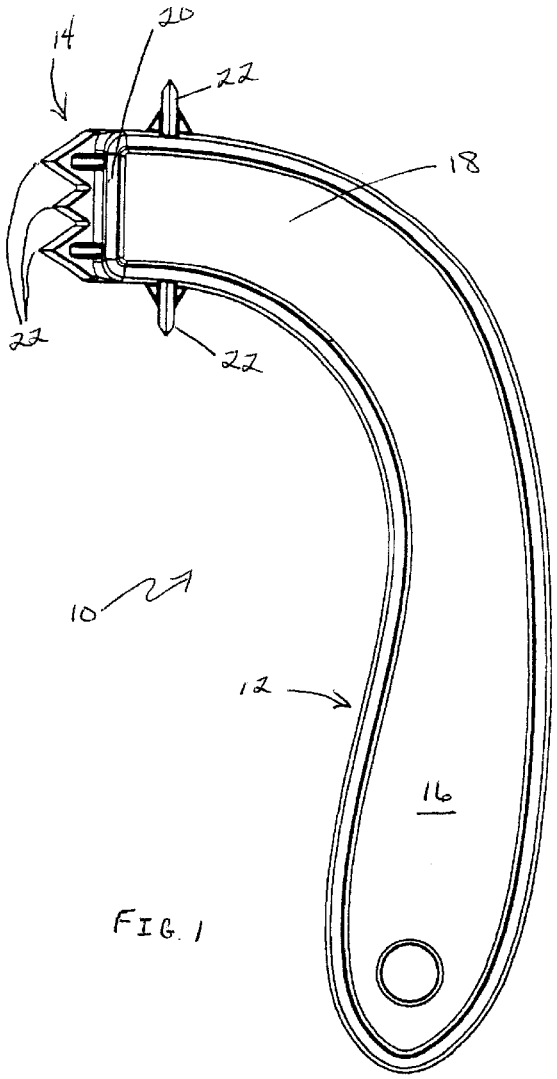
FIG. 1 is a side view of the present invention.
Figure 2:
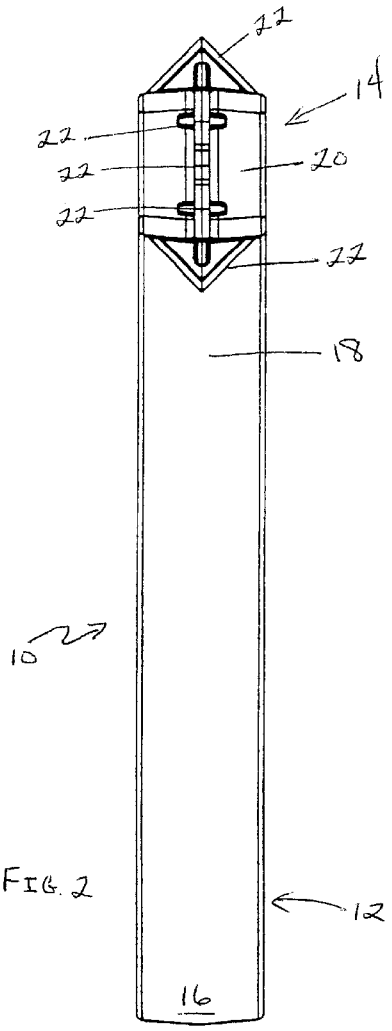
FIG. 2 is a front view of the present invention.
Figure 3:
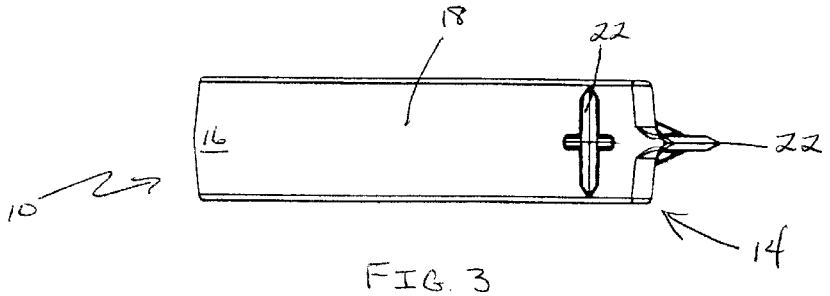
FIG. 3 is a top perspective view of the present invention.

The present inventive device 10, shown in FIGS. 1 through 3, includes a handle mechanism 12 and a tape cutting mechanism 14. These mechanisms 12 and 14 will be described in more detail below.

The handle mechanism 12 may be of a variety of shapes. The handle mechanism 12 is preferably ergonomically shaped, perhaps an elongated S-shape. The handle mechanism 12 includes a base 16, a neck 18, and a stopping mechanism 20. The base 16, the neck 18 and the stopping mechanism 20 will be discussed in more detail below.

The handle mechanism 12 may be a variety of sizes and materials. The handle mechanism 12 preferably is approximately five to seven inches in length, may range from less than one inch to more than three inches in thickness, and may range from less than one inch to more than three inches wide. The handle mechanism 12 may be wider at the base 16 than at the neck 18. The neck 18 may be wider than the stopping mechanism 20. The handle mechanism 12 preferably will be constructed of plastic or any other suitable material and may including ribbing for better grip and functioning. The material should be strong enough to prevent breakage and, yet, light for portability and handling.

The handle mechanism 12 includes the base 16. The base 16 preferably is sized for easily being gripped by the user of the present invention 10 with one hand. The base 16 preferably is shaped so that either a right-handed user or a left-handed user may easily use the present invention 10.

The handle mechanism 12 includes the neck 18. The neck 18 is preferably slightly curved. The curve allows for easier cutting when the present invention 10 is in use. The neck 18 may be continuous with the base 16 at one end and the stopping mechanism 20 at the opposite end.

The stopping mechanism 20 may be any mechanism that stops the tape cutting mechanism 14 from penetrating the box too deeply. The stopping mechanism 20 may be a flat stopping surface of the handle 12 that prevents the tape cutting mechanism 14 from penetrating the box too deeply. The stopping mechanism 20 may be continuous with the tape cutting mechanism 14 or the tape cutting mechanism 14 may be attached to the stopping mechanism 20 at one end and the stopping mechanism 20 may be continuous with the neck 18 at the opposing end.

The tape cutting mechanism 14 may be any mechanism that is sharp enough to puncture and cut through tape on taped boxes, yet dull enough to substantially avoid puncturing and cutting human skin. The tape cutting mechanism 14 may include a plurality of pointed edges 22. It has been found that a good pointed edge 22 may be formed of a piece of plastic angled between approximately 25° and approximately 135° on the body (as opposed to the edge) and have a cutting edge between 0.001 and 0.1 inches thick. Preferably, the body is approximately 90° and the cutting edge is 0.01 inches thick as shown in FIG. 1. The pointed edges 22 may be located along the sides of the neck 18. The pointed edges 22 may be located at the tip of the stopping mechanism 20. The pointed edges 22 may be located at both the sides of the neck 18 and the tip of the stopping mechanism 20.

The present invention 10 is easily used to open taped boxes. The user grips the handle mechanism 12 at the base 16. The tape cutting mechanism 14 is placed adjacent to the tape on the taped box. A slight amount of pressure is applied to the pointed edge 22 that is in contact with the tape using the handle mechanism 12. The stopping mechanism 20 will prevent the pointed edge 22 from being inserted too deeply into the box. Once the pointed edge 22 has punctured the tape, the handle mechanism 12 is pulled forward, backward, upward or downward to pull the pointed edge 22 through the remaining intact tape. The present invention 10 may be used on the top, sides, and/or bottom of the box to release the tape. Once the tape has been cut open, the user may remove the present invention 10 from contact with the box. The flaps of the box may now be opened and the contents removed.

Although the present invention has been described with reference to preferred embodiments, workers skilled in the art will recognize changes may be made in form and detail without departing from the spirit and scope of the invention.

I claim:

1. A box opening device comprising:

base, neck, and means for stopping;

means for cutting being a plurality of pointed edges, the means for cutting having at least five pointed edges, at least three pointed edges being homogenous with the neck and being located on opposing sides of the neck and at least two pointed edges being homogenous with the means for stopping and being adjacent one another.

2. The device in claim 1 wherein:

the device is plastic.

3. A box opening device comprising:

a handle, which is an elongated S-shape, having a base, a neck, and a stopping surface; the base being homogenous with the neck, the neck being homogenous with the stopping surface; the handle ranging five to seven inches in length; the handle ranging from less than one inch to more than three inches in thickness; the handle ranging from less than one inch to more than three inches wide;

at least four pointed edges being homogenous with the neck and the stopping surface; two pointed edges being homogenous with the neck; two pointed edges being homogenous with the stopping surface;

the handle and the pointed edges being plastic.

4. the device in claim 1 wherein:

the means for holding the device is an elongated S-shape.

5. The device in claim 4 wherein:

the means for holding is a handle.

6. The device in claim 5 wherein:

the handle ranges from five to seven inches in length.

7. The device in claim 5 wherein:

the means for stopping is a stopping surface, the stopping surface being homogenous with the handle.

8. The device of claim 5 wherein:

the handle has ribbing.

* * * * *